United States Patent [19]

Curtis et al.

[11] Patent Number: 4,924,779

[45] Date of Patent: May 15, 1990

[54] LONG-TRAVEL SIDE BEARING FOR AN ARTICULATED RAILROAD CAR

[75] Inventors: Richard D. Curtis, Munster, Ind.; Shaun Richmond, Orland Park, Ill.

[73] Assignee: Thrall Car Manufacturing Company, Chicago Heights, Ill.

[21] Appl. No.: 312,957

[22] Filed: Feb. 21, 1989

[51] Int. Cl.[5] ..... B61F 5/14

[52] U.S. Cl. ..... 105/4.1; 105/197.1; 105/199.3; 267/28; 267/216; 267/286

[58] Field of Search ..... 105/4.1, 199.3, 199.2, 105/199.1, 198.2, 197.05, 453, 4.2, 4.3, 197.1; 267/4, 6, 7, 195, 196, 216, 286–291, 166, 28, 170, 178; 384/423, 595, 215, 223, 224

[56] References Cited

U.S. PATENT DOCUMENTS

| | | | |
|---|---|---|---|
| 577,007 | 2/1897 | Cliff | 384/423 |
| 709,969 | 9/1902 | Denegre | 267/216 X |
| 829,437 | 8/1906 | Shea | 384/423 X |
| 1,728,336 | 9/1929 | Downey | 384/423 |
| 1,755,869 | 4/1930 | Downey | 384/423 |
| 1,933,458 | 10/1933 | Symington | 105/199.3 X |
| 2,259,608 | 10/1941 | Blattner | 384/423 |
| 2,285,140 | 6/1942 | Barrows et al. | 384/423 |
| 2,495,920 | 1/1950 | Dentler | 267/216 |
| 2,515,853 | 7/1950 | Blattner | 384/423 |
| 2,571,190 | 10/1951 | Blattner | 384/423 X |
| 2,636,789 | 4/1953 | Blattner | 267/216 X |
| 2,830,857 | 4/1958 | Blattner | 384/423 |
| 3,244,462 | 4/1966 | Barber et al. | 105/199.3 X |
| 3,255,712 | 6/1966 | Barber | 105/199.3 |
| 3,709,151 | 1/1973 | Cook et al. | 105/199.3 X |
| 3,712,691 | 1/1973 | Cope . | |
| 3,717,107 | 2/1973 | Pangalila | 105/199.3 |
| 3,748,001 | 7/1973 | Neumann et al. | 384/423 |
| 3,797,674 | 3/1974 | Reynolds | 384/423 X |
| 3,897,737 | 8/1975 | Davis | 105/199.3 |
| 3,910,655 | 10/1975 | Willison et al. . | |
| 3,981,548 | 9/1976 | MacDonnell et al. | 105/199.3 X |
| 4,022,449 | 5/1977 | Estorff . | |
| 4,080,016 | 3/1978 | Wiebe . | |
| 4,130,066 | 12/1978 | Mulcahy | 105/199.3 |
| 4,712,487 | 12/1987 | Carlson . | |
| 4,817,535 | 4/1989 | Terlecky . | |

FOREIGN PATENT DOCUMENTS

| | | | |
|---|---|---|---|
| 2191162 | 12/1987 | United Kingdom | 105/199.2 |

OTHER PUBLICATIONS

Brochure entitled "Specification for Truck Side Bearing"—Association of American Railroads, Mechanical Division, Manual of Standards and Recommended Practices (4/1/84).

Brochure entitled "Miner TecsPack TCC-II Side Bearings for Articulated Freight Cars", (9/88).

Brochure entitled "Stucki Hi-Performance Metal Capped Resilient Side Bearings", (6/86).

Brochure for ASF Side Bearings (undated).

*Primary Examiner*—Douglas C. Butler

*Attorney, Agent, or Firm*—Neuman, Williams, Anderson & Olson

[57] ABSTRACT

An articulated railroad car, which includes an articulated connector, rail truck and car body units, has at least one standard short-travel railroad car side bearing which is designed to permit down travel of the car body unit of at least ⅝ inch. In a preferred embodiment, one rail truck portion includes a long-travel railroad car side bearing. The long-travel side bearing includes a top cap member and a bottom member with a resilient member interposed therebetween. The long-travel side bearing permits roll axis movement of one car body unit relative to another car body unit to reduce forces on the rail truck which would tend to prevent its successful negotiation of curves.

13 Claims, 4 Drawing Sheets

FIG. 3
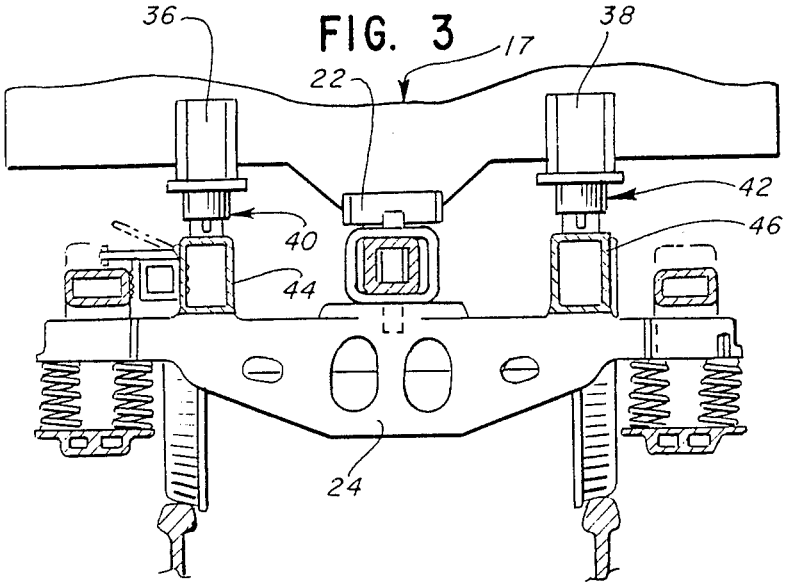
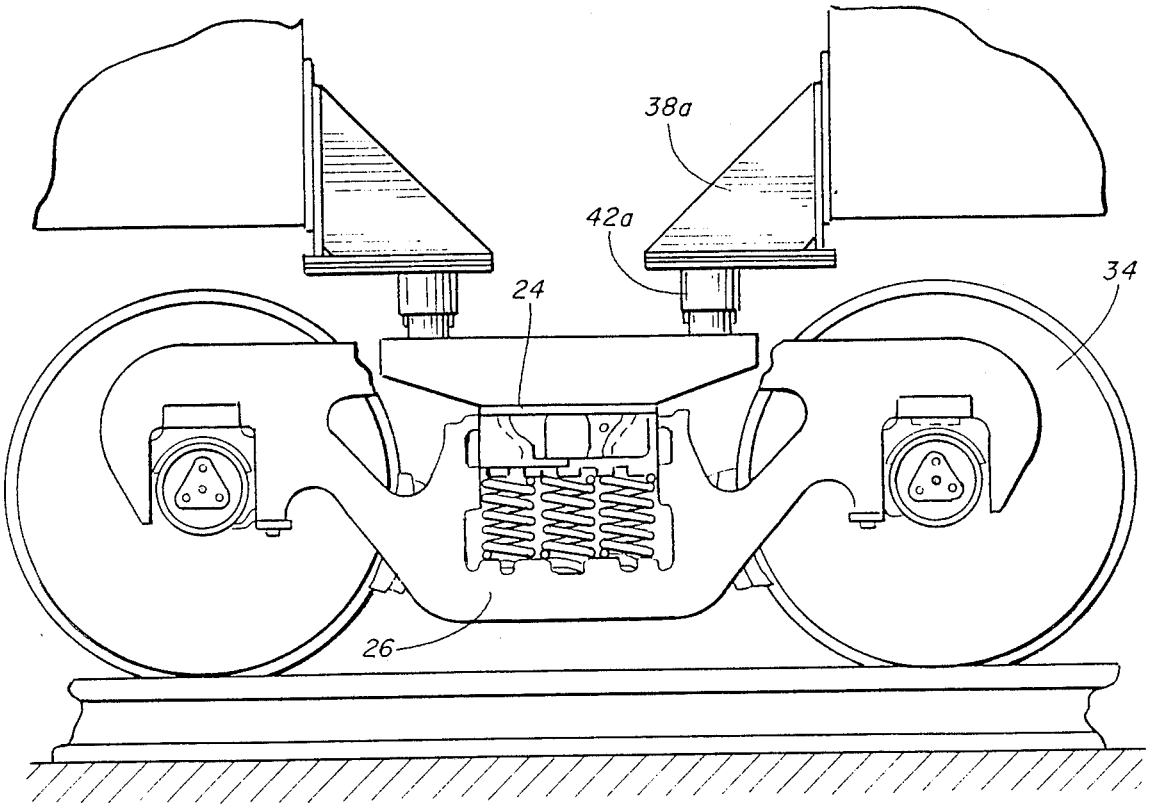
FIG. 4

FIG. 8
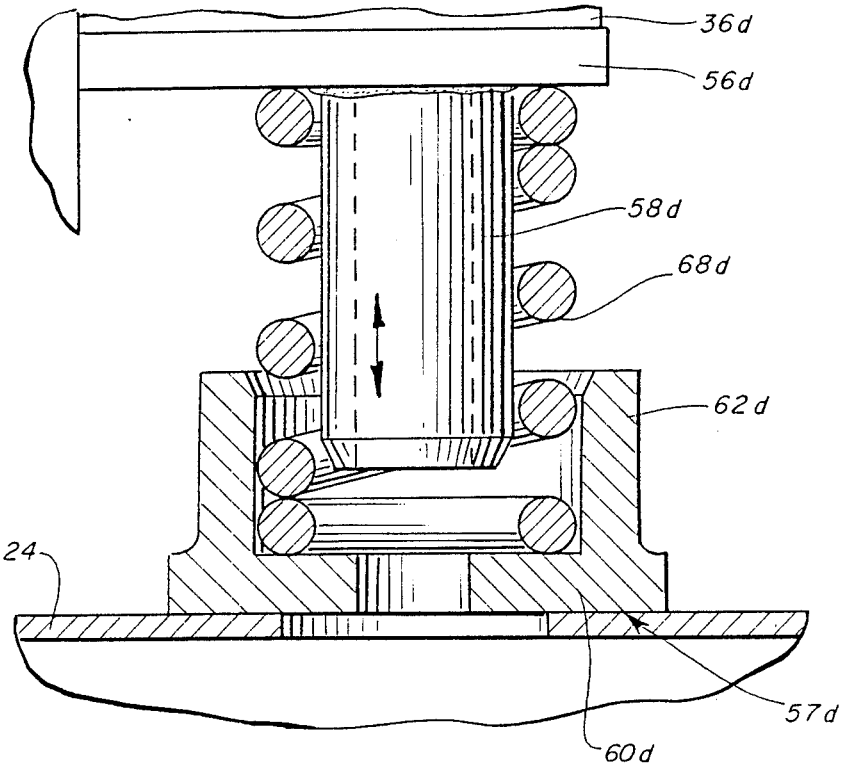
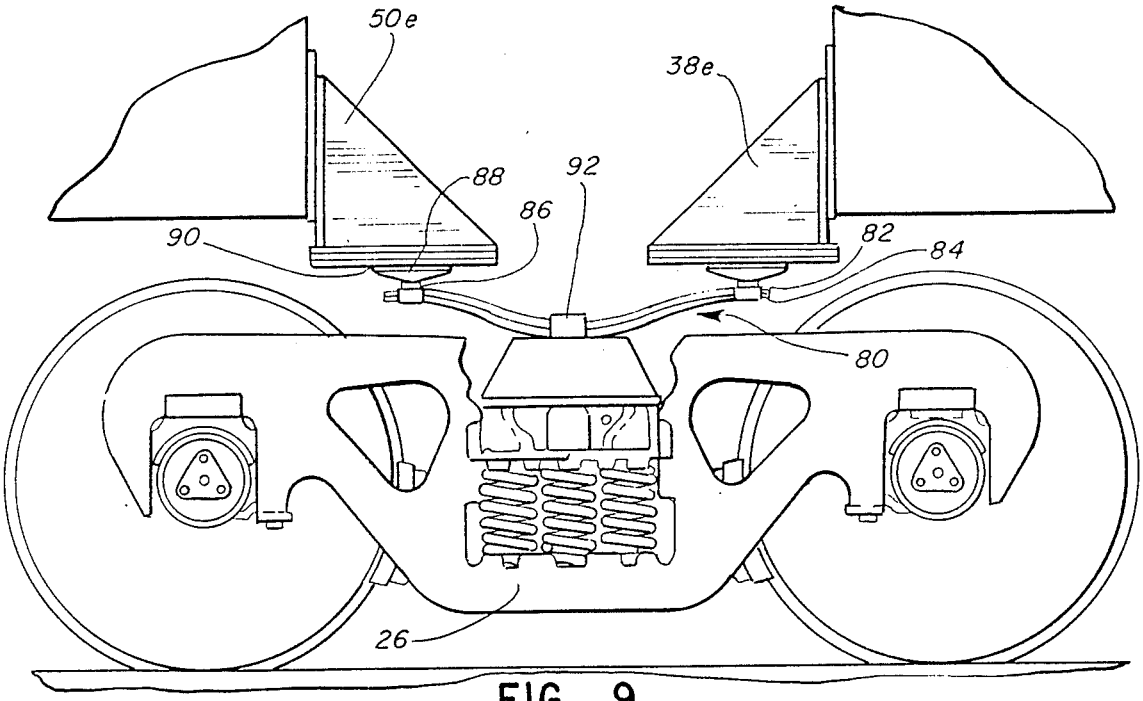
FIG. 9

LONG-TRAVEL SIDE BEARING FOR AN ARTICULATED RAILROAD CAR

BACKGROUND OF THE INVENTION

1. Field of the Invention

The present invention relates to side bearings used in railroad cars and, more particularly, to a long-travel side bearing for use with articulated railroad cars to permit a controlled torsional flexibility across the articulation joint connecting the car body units.

2. Description of the Prior Art

A variety of constant contact side bearings have been developed for use in railroad cars. On a standard railroad car, the side bearing units are typically located directly on the rail truck bolster. On an articulated car, the side bearing units are typically located on a bracket mounted on the truck bolster.

Such a standard constant contact side bearing unit is commonly used in an attempt to control hunting of the railroad car. Hunting is a phenomenon caused by yaw axis rotation of the railroad car truck. As the cone-shaped wheels ride along the track, a yaw axis motion is induced in the truck. As the truck yaws, an upper portion of the side bearing is made to slide across the underside of the car body. The resulting friction produces an opposing torque which acts to prevent yaw motion. A further purpose of the standard side bearing is to limit the total roll motion of the car body.

In order to control or limit the roll axis rotation of the railroad car, the side bearings of the prior art are designed to provide a roll stop or motion limitation action. Some prior art side bearings act simply as roll limitation pads or stops which provide a simple roll prevention or limitation device. These side bearings do not necessarily continuously contact the car body and do not attempt to restrain yaw axis movement of the truck.

Other prior art side bearings typically consist of a housing containing spring loaded steel elements or elastomeric materials. These bearings bear continuously against the car body throughout the compression of the spring. The spring or elastomeric material acts essentially to keep the upper element in contact with the car body to prevent or restrict yaw axis motion of the truck. The maximum travel of such a standard side bearing is specified by the appropriate Association of American Railroads (A.A.R.) standard (Standard M-948-77) to be limited to $\frac{5}{8}$ inch.

Each of these prior art devices is therefore directed to the restraint of yaw axis motion of the truck and limitation of roll axis movement of the car body units. For example, U.S. Pat. No. 4,712,487 discloses a standard side bearing with a housing containing an elastomeric device. The device is made of polymer material and has a non-linear compressive spring rate which increases exponentially as the device is compressed. The patent specifically teaches a limitation of roll axis movement to $\frac{1}{2}$ inch.

Another example of a standard side bearing is shown in U.S. Pat. No. 4,080,016. This bearing includes a pair of elastomeric blocks spaced apart by a saddle block. An upper surface of the saddle block has a cusp to separate a pair of roller bearings. Again, the patent teaches a mechanism to limit roll axis movement.

None of the prior art side bearings allows long-travel of the bearing to permit the necessary roll axis movement of the rail car body which has been found to be needed with an articulated rail car. This presents a problem in the use of certain articulated rail cars. In articulated rail cars, the extreme length of the rail car requires free torsional movement of the car body units, particularly as the units traverse a curved or banked portion of the rail. At such a curve, the outer rail is raised (or super-elevated) in relation to the inner rail to form a banked curve. In the approach to such a curve, there is a transition from the straight (not super-elevated) track to the curved (super-elevated) track. This causes a twisting of the rail car as it traverses this section of the track. The restriction of roll axis movement by the side bearings of the prior art prevents relative roll axis movement of one car unit with respect to another car unit. The restriction in roll axis movement can result in high twist loads being imposed at the articulation joint. This can apply such forces to the rail truck as to prevent the yaw axis rotation necessary for the car to successfully negotiate the curve.

The need for a long-travel side bearing has arisen as the units of articulated rail cars have become stiffer in torsion. This increase in stiffness is a by-product of the increasing load-carrying capacity of the units. The increased capacity units have exhibited a tendency to derail upon the entry to curves by forcing over the inner or low rail.

In such circumstances, as an articulated car enters a curve, the entire five unit car is twisted in the banking of the curve. On these cars, the connection of one unit to another is through an articulated connector. The connector has a female part that sits in the truck bowl in the same manner that the center plate of a standard freight car sits in the truck bowl. The male portion of the connector is fabricated into the adjacent unit. The connection is formed by the male portion fitting into the female portion. The male portion does not necessarily make contact with the truck bolster.

During the turning of the car on the banked rail curve, the short travel of a standard short-travel bearing prevents the rotation of the male portion within the female portion. The result is the placement of a very high load on the side bearing. This high side bearing load applied at a significant distance from the center of yaw rotation of the truck causes the application of a large yaw moment to the truck as it enters the curve. This yaw moment interferes with the proper yaw motion of the truck. Under certain conditions, particularly those where rail lubrication is present only on the upper or high rail, the result is excessive force on the low rail and the potential rolling over the low rail.

OBJECTS OF THE INVENTION

Accordingly, it is an object of this invention to provide an articulated railroad car with a side bearing system which allows some relative roll axis movement of one unit of the car relative to the next unit.

It is a specific object of this invention to provide an articulated railroad car with a standard side bearing acting in conjunction with a long-travel side bearing to permit controlled, relative roll axis movement of the car body units.

It is a specific object of this invention to provide a long-travel side bearing which is in the form of a leaf spring system.

It is another object of this invention to provide an articulated railroad car with a long-travel side bearing having a spacer material which permits transverse motion of the top portion of the bearing when in a compressed state, but resists longitudinal motion so as to remain effective in resisting hunting.

Other objects, advantages and features of the present invention will become apparent upon reading the following detailed description and appended claims, and upon reference to the accompanying drawings.

SUMMARY OF THE INVENTION

In accordance with an embodiment of this invention, an articulated railroad car which achieves the foregoing objects includes a standard articulated connector, rail truck and car body. The rail truck includes two portions which are forward and rearward of the connector. One of the truck portions has at least one standard short-travel railroad car side bearing. The second truck portion includes at least one long-travel railroad car side bearing to permit controlled relative roll axis movement between the car body units.

The long-travel side bearing includes a top cap member and a bottom member. The top cap member has an upper portion and a downwardly extending side portion. The bottom member has a base portion and an upwardly extending sleeve member. A spacer member, in the form of a filler material, extends along a portion of the periphery of the sleeve member. The sleeve member is slidable within the side portion, with the side portion enclosing the sleeve member and the spacer means. A coil spring or elastomeric spring is interposed between the top cap member and the bottom member.

In accordance with another embodiment of this invention a long-travel railroad side bearing unit is provided which is configured to permit greater than $\frac{5}{8}$ inch down travel of the rail car body unit. One embodiment of this long-travel bearing is configured to include a leaf-spring system which is slidingly engaged with the car body unit.

BRIEF DESCRIPTION OF THE DRAWINGS

For a more complete understanding of this invention, one should refer to the embodiments illustrated in greater detail in the accompanying drawings and described below by way of examples of the invention. In the drawings:

FIG. 3 is a sectional view taken along line 3—3 of FIG. 2, which also includes the car body end;

FIG. 4 is a right side elevation view of the truck with truck side frame cut-away to show the side bearing support bracket;

FIG. 8 is a side sectional view of another alternate embodiment; and

FIG. 9 is a side elevation view of an alternate embodiment of the present invention having a leaf spring system.

DETAILED DESCRIPTION OF THE DRAWINGS

Figure 1:
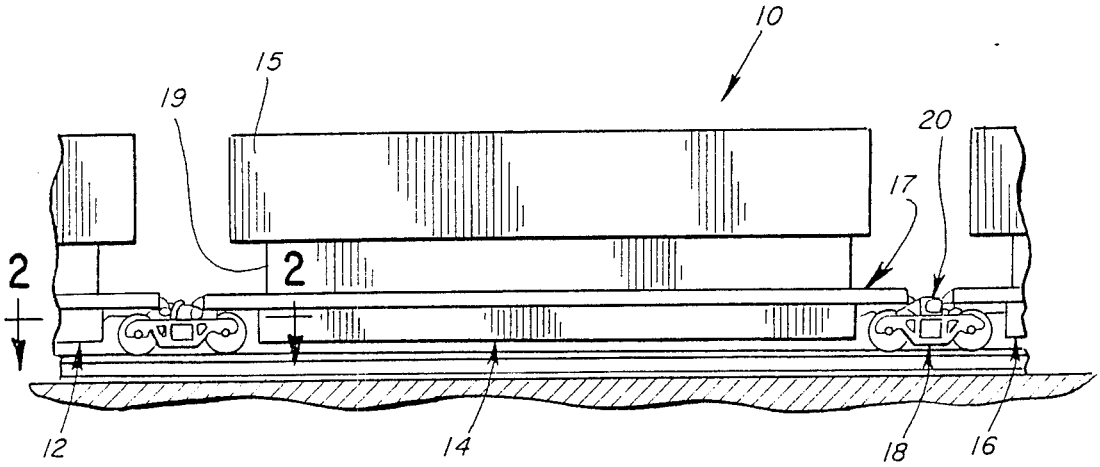
FIG. 1 is a side elevational view of a portion of an articulated rail car with the long-travel side bearing of the present invention.

Turning now to the drawings, FIG. 1 shows a portion of an articulated car generally at 10 which is formed of a series of units 12, 14 and 16. Each unit includes a car body, such as shown generally at 17. Containers 15, 19 are shown double-stacked on the car body. Adjacent end portions of the units are supported on conventional rail trucks, such as truck 18. A typical car consists of five units supported by six trucks. Each of the units is connected to the other by an articulated connector, such as shown at 20. The connector 20 allows yaw axis rotation about center pin 22, shown in FIGS. 2 and 3. Divided at the center pin are the truck forward portion, shown generally at 23, and the truck rear portion, shown generally at 25.

Figure 2:
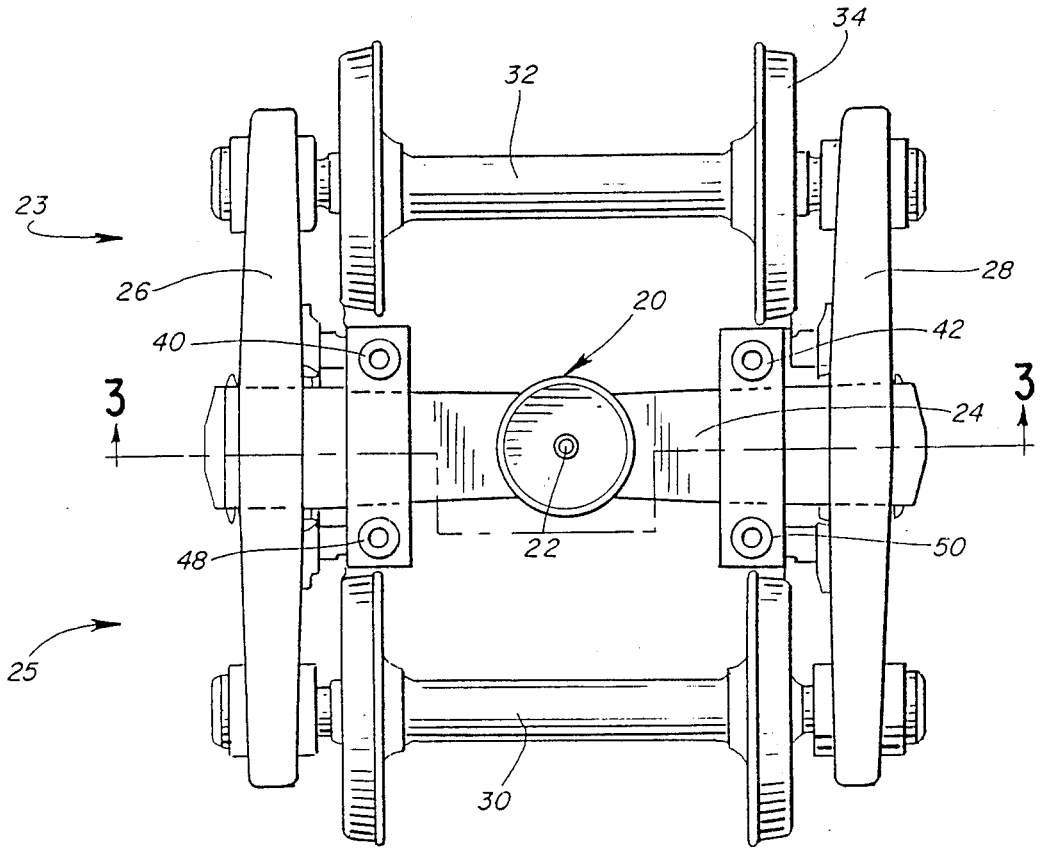
FIG. 2 is a view of the truck of FIG. 1 taken along the line 2—2 of FIG. 1.

The truck 18 is shown in greater detail in FIGS. 2 and 3. The truck 18 includes truck bolster 24 and side frames 26, 28. The truck bolster 24 and side frames are also shown in FIG. 4. The truck also includes axles 30, 32 containing wheels 34. The axles 30, 32 are mounted in the side frames 26, 28.

At the end of unit 14 are a pair of side bearing support arms 36, 38. The bearing support arms rest on side bearing units 40, 42. Similar support arm 38*a* is shown in FIG. 4 as resting on similar bearing unit 42*a*. The side bearing units 40, 42 are located on top of fabricated assemblies or side bearing support brackets 44, 46, which are positioned on top of the bolster 24. These side bearing units 40, 42 are located on the forward portion of the truck and are of the long-travel variety of the present invention. The rear portion of the truck also contains side bearing units 48, 50. These side bearing units 48, 50 are of the standard construction of the prior art.

The preferred construction of the present invention is to provide the long-travel bearing unit in conjunction with the car body unit having the male portion of the articulated connector. Since the female portion of the articulated connector rests firmly on the truck bolster, it is not as effective to place the long-travel side bearing on the portion with the unit with the female connector.

Figure 5:
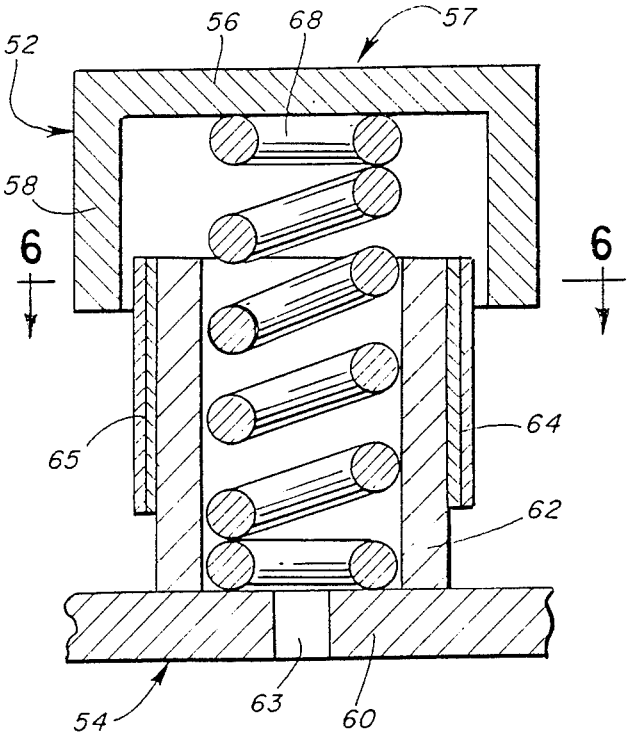
FIG. 5 is a side sectional view of the long-travel bearing of the present invention.
Figure 6:
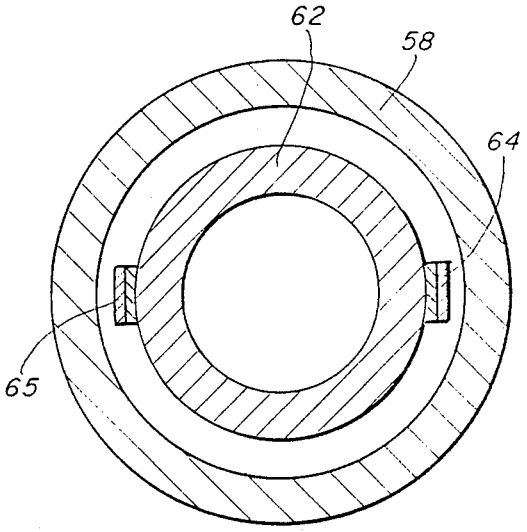
FIG. 6 is a sectional view taken along line 6—6 of FIG. 5.

FIG. 5 shows the construction of one embodiment of the long-travel side bearing units 36, 38 of the present invention. The bearing unit includes a top cap member 52 and a bottom member 54. The top member 52 includes an upper portion 56, with a wear plate assembly 57 on its upper surface, and a side portion 58. The side portion 58 extends down from the upper portion. The side portion 58 may be in the form of a cylindrical member, as shown in FIG. 6.

The bottom member 54 includes a base portion 60 and a sleeve member 62. The base portion may include a drain hole 63. The sleeve member 62 extends upward from the base portion 60 and may also be in the form of a cylindrical member. As shown in FIG. 5, in one embodiment, the sleeve member 62 fits within the side portion 58 of the top cap member 52 and is capable of sliding therein.

A filler material or spacer 64, 65 is provided in two strips along the forward side and rear side of the outside of the sleeve member 62, between the sleeve member and the top cap member. Thus, spacer 64 is located toward the truck forward portion and spacer 65 is located toward the truck rear portion. The spacers permit sliding of the top cap member around the sleeve member. The spacers also permit the top cap member 52 to rock about a longitudinal axis with respect to the base portion 60, but prevent forward and aft movement so that hunting control is maintained. This rocking motion is allowed as necessary in that the car body does not move vertically downward after the bearing is fully compressed, but rocks about the center of the articulated coupler. Preferably, a minimum gap is provided between spacers 64, 65 and side portion 58. The filler material is preferably steel.

A resilient means 68 is provided between the top cap member and the bottom member. In the preferred embodiment, the resilient means is in the form of a coil spring. However, the resilient means may be formed of any other suitable resilient material, such as a rubber stack elastomer. The resilient means 68 is provided with a sufficiently low spring rate to permit long-travel of the top member. This extended travel, beyond the Association of American Railroads (A.A.R.) standard limit of $\frac{5}{8}$ inch, permits the necessary controlled roll axis movement of the unit, thereby imparting torsional flexibility between the car units. The down-travel of the car body unit is beyond $\frac{5}{8}$ inch and it has been determined such travel should be limited to no more than 3 inches.

Figure 7:
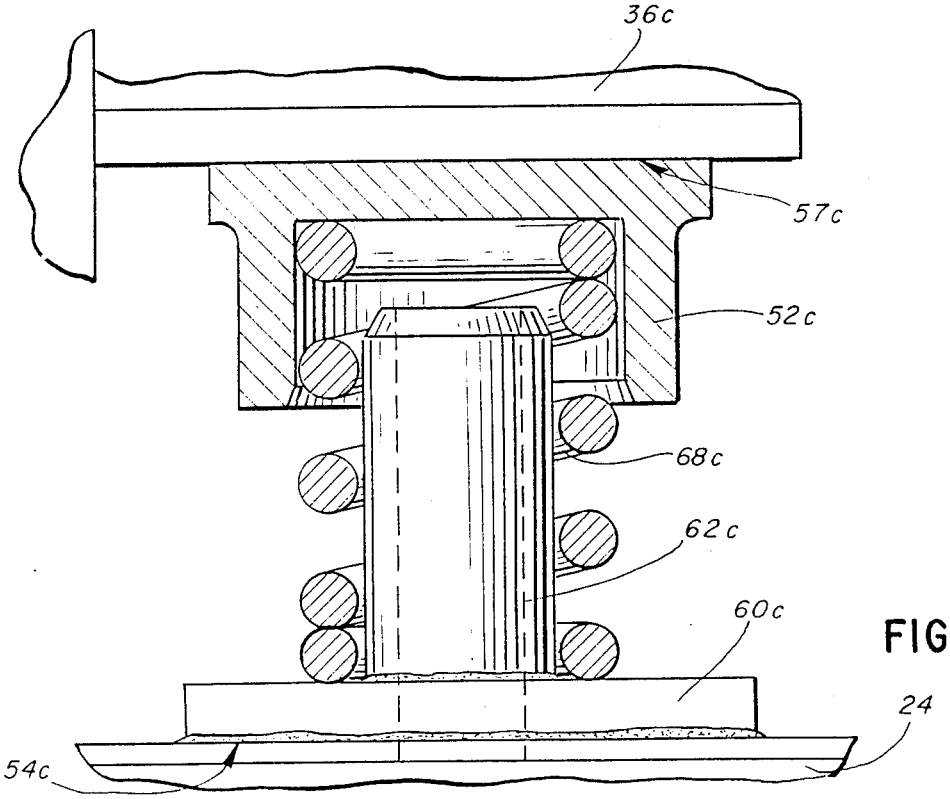
FIG. 7 is a side sectional view of an alternate embodiment of the present invention.

An alternative embodiment of the long-travel side bearing unit is shown in FIG. 7. In this embodiment, the side bearing arm 36*c* is in sliding engagement with the top cap member 52*c* along wear plate assembly 57*c*. The bottom member 54*c* includes an upright post member 62*c*, in lieu of the open cylindrical sleeve member 62 of the embodiment of FIG. 5. The resilient member 68*c*, which is preferably in the form of a coil spring of hardened steel, is placed around the post member 62*c*. Base portion 60*c* is fixedly attached to the bolster 24 by welding or the like.

Another alternative embodiment is shown in FIG. 8. In this embodiment, the upper portion 56*d* of the top cap member is fixedly attached to the bearing support arm 36*d*. The side portion 58*d* of the top cap member is in the form of a post member. The resilient member 68*d* surrounds the post member 58*d* and is set against base portion. The base portion of the bottom member slides against the bolster 24, along wear plate assembly 57*d*.

Another alternative embodiment is shown in FIG. 9. In this embodiment, the resilient member of the long-travel side bearing is formed of a leaf spring system 80. The leaf spring system extends between a first car body unit section and a second car body unit section. The leaf spring system has a first end slidingly connected to the first unit section at the side bearing arm 38*e* and a second end slidingly connected to the second unit section at the side bearing arm 50*e*.

The spring system itself comprises one or more leafs 82, 84 which are layered in the standard manner. A leaf spring system is described in U.S. Pat. No. 4,022,449. Fixedly attached to the leaf spring 82 at one end is a shoe 86. The shoe 86 slides against a wear plate 88 which is operatively disposed above the shoe. The leaf may be designed to eliminate the need for the shoe. The wear plate 88 is in turn attached to the side bearing arm 50*e*. There may be one or more shims 90 interposed between the wear plate and the arm. The leaf spring system is attached at its mid-section to the truck bolster 24 by a leaf spring support bracket 92. The opposing end of the leaf spring contacts side bearing arm 38*e* in a similar manner. The leaf spring is configured to obtain the desired fixed and/or variable spring rates and damping.

The leaf spring system acts in a similar manner to the long-travel bearing embodiments previously described. The leaf spring system provides a long-travel spring-damping system which allows controlled relative roll axis movement between the car units. In this embodiment, both of the bearing units are long-travel bearing units and both extend from a front body unit to a rear body unit.

Each of the embodiments described provides a long-travel side bearing for the articulated rail car. In operation, the articulated rail car body units attempt to roll with respect to one another as the train passes over a banked section of track. The conventional use of only the standard side bearing units of the prior art prevents this roll axis movement. The result is an increase in the forces on the truck which prevent the yaw axis movement of the truck necessary for the truck to successfully negotiate the turn. The addition of the long-travel side bearing units of the present invention to at least one section of the truck allows controlled roll axis movement of the rail cars. This reduces forces on the truck which act to prevent its turning to negotiate the curve.

Additionally, the structure of the long-travel side bearing allows a transverse motion of the top portion of the bearing. This allows for a rocking of the top of the side bearing in relation to the base, which rocking takes place when the roll axis motion occurs. Prevention of longitudinal motion allows the side bearing to remain effective as a hunting control mechanism.

While several embodiments of the invention are illustrated, it will be understood that the invention is not limited to these embodiments. Those skilled in the art to which the invention pertains may make modifications and other embodiments employing the principles of this invention, particularly upon considering the foregoing teachings.

What is claimed is:

1. An articulated railroad car having a standard railroad car side bearing and a long-travel side bearing, said standard railroad car side bearing having a housing and a first resilient means operatively connected to said housing, said first resilient means having a spring rate sufficiently high to prevent compression of said housing greater than $\frac{5}{8}$ inch, said long-travel side bearing comprising:

a top cap member having an upper portion and a downwardly extending side portion;

a bottom member having a base portion and an upwardly extending sleeve member, said sleeve member slidably engaged within said side portion; and second resilient means interposed between said top cap member and said bottom member, said second resilient means having a spring rate sufficiently low to permit greater than $\frac{5}{8}$ inch displacement of said top cap member relative to said bottom member.

2. An articulated railroad car having a standard railroad car side bearing and a long-travel railroad car side bearing, said standard railroad car side bearing having a housing and a first resilient means disposed within said housing, said first resilient means having a spring rate sufficiently high to prevent compression of said housing greater than $\frac{5}{8}$ inch, said long-travel side bearing comprising:

a top cap member having an upper portion and a downwardly extending side portion;

a bottom member having a base portion and an upwardly extending sleeve member;

spacer means extending about the outer periphery of said sleeve member; said sleeve member slidably engaged within said side portion, said side portion enclosing said sleeve member and said spacer means; and second resilient means interposed between said top cap member and said bottom member, said second resilient means having a spring rate sufficiently low to permit greater than $\frac{5}{8}$ inch displacement of said top cap member relative to said bottom member.

3. The long-travel railroad car side bearing of claim 2 wherein said second resilient means is a coil spring.

4. The long-travel railroad car side bearing of claim 2 wherein said second resilient means is a rubber stack elastomer.

5. The long-travel railroad car side bearing of claim 2 wherein said second resilient means is interposed within said sleeve member.

6. The long-travel railroad car side bearing of claim 2 wherein said sleeve member is an upright post member.

7. The long-travel railroad car side bearing of claim 6 wherein said second resilient means surrounds said upright post member.

8. An articulated railroad car having an articulated connector, truck and car body, said truck including a first truck portion and a second truck portion divided at said connector, said first truck portion including at least one standard railroad car side bearing, said standard railroad car side bearing having a housing and a first resilient means disposed within said housing, said first resilient means having a spring rate sufficiently high to prevent compression of said housing greater than $\frac{5}{8}$ inch, said second truck portion including at least one long-travel railroad car side bearing, said long-travel side bearing comprising:

a top cap member having an upper portion and a downwardly extending side portion;

a bottom member having a base portion and an upwardly extending sleeve member;

spacer means extending about the outer periphery of said sleeve member; said sleeve member slidably engaged within said side portion of said top cap member, said side portion enclosing said sleeve member and said spacer means; and second resilient means interposed between said top cap member and said bottom member, said second resilient means having a spring rate sufficiently low to permit greater than $\frac{5}{8}$ inch displacement of said top cap member relative to said bottom member.

9. The articulated railroad car of claim 8 wherein said top cap member is slidably engageable with said car body and said bottom member is fixedly attached to said bolster.

10. The articulated railroad car of claim 8 wherein said top member is fixedly attached to said car body and said bottom member is slidably engageable with said bolster.

11. An articulated railroad car having an articulated connector, truck and a plurality of car body units, said truck including a first portion and a second portion divided at said connector, said truck including at least one standard railroad car side bearing and at least one long-travel railroad car side bearing extending between a first car body unit disposed above said first truck portion and a second car body unit disposed above said second truck portion, said long-travel side bearing comprising:

a leaf spring system having a first end, a second end, a mid-section and one or more leaves, said leaf spring system operatively connected to said first car body unit for sliding engagement at said first end and operatively connected to said second car body unit for sliding engagement at said second end, said leaf spring system being operatively connected to a truck bolster at said mid-section.

12. An articulated railroad car formed of a plurality of interconnected car body units, each connection including at least one rail truck and at least one standard railroad car side bearing and at least one long-travel side bearing unit mounted on said rail truck, said long-travel side bearing unit comprising a housing and resilient means operatively connected to said housing, said resilient means having a spring rate sufficiently low to permit greater than $\frac{5}{8}$ inch down travel of a corresponding car body unit.

13. The articulated railroad car of claim 12 wherein said long-travel side bearing unit comprises:

a leaf spring system having a first end, a second end, a mid-section and one or more leaves, said leaf spring system operatively connected to said first car body unit for sliding engagement at said first end and operatively connected to said second car body unit for sliding engagement at said second end, said leaf spring system being operatively connected to a truck bolster at said mid-section.

* * * * *